US009972945B1

(12) United States Patent
Huang et al.

(10) Patent No.: US 9,972,945 B1
(45) Date of Patent: May 15, 2018

(54) ELECTRICAL CONNECTOR STRUCTURE WITH IMPROVED GROUND MEMBER

(71) Applicant: SPEED TECH CORP., Taoyuan (TW)

(72) Inventors: Kuo-Hua Huang, Taoyuan (TW); I-Ting Hsieh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days. days.

(21) Appl. No.: 15/669,982

(22) Filed: Aug. 7, 2017

(30) Foreign Application Priority Data

Apr. 6, 2017 (TW) ..... 106204894 U

(51) Int. Cl.
*H01R 13/648* (2006.01)
*H01R 13/6585* (2011.01)
*H01R 24/60* (2011.01)
*H01R 13/6586* (2011.01)

(52) U.S. Cl.
CPC ..... *H01R 13/6585* (2013.01); *H01R 24/60* (2013.01); *H01R 13/6586* (2013.01)

(58) Field of Classification Search
None
See application file for complete search history.

(56) References Cited

U.S. PATENT DOCUMENTS 8,808,029 B2 8/2014 Castillo et al.
9,640,923 B2 * 5/2017 Kao ..... H01R 12/724
2014/0073190 A1 * 3/2014 Zhao ..... H01R 13/6594 439/626
2016/0149348 A1 * 5/2016 Kao ..... H01R 13/6585 439/607.05

* cited by examiner

*Primary Examiner* — Tho D Ta
(74) *Attorney, Agent, or Firm* — CKC & Partners Co., LTD.

(57) ABSTRACT

A electrical connector structure includes ground terminals formed in two rows, which are fixed into two bases respectively, in which each of the ground terminals includes a contact portion, a soldering portion and a main body is connected to the contact portion and the soldering portion, and each main body is fixed into the bases, and each soldering portion extends out of the bases; and a ground member including two ground plates, in which the ground plates covering surfaces of the bases, respectively, and a surface of each ground plate has a plurality of contact arms protruding, the contact arms are electrically contacted to the ground terminals, respectively, in which two ends of each contact arm contact the ground plates, respectively.

9 Claims, 12 Drawing Sheets

ELECTRICAL CONNECTOR STRUCTURE WITH IMPROVED GROUND MEMBER

RELATED APPLICATIONS

This application claims priority to Taiwan Application Serial Number 106204894, filed Apr. 6, 2017, which is herein incorporated by reference.

BACKGROUND

Technical Field

The present disclosure relates to an electrical connector structure. More particularly, the present disclosure relates to a technology for shielding an electromagnetic signal.

Description of Related Art

Due to the extensive development of information technology and dramatically increasing various files and video streaming information, conventional data transmission methods cannot meet requirements of high-speed information transmission. For a serial technology required for high-speed information access, serial attached SCSI (SAS) can be used to overcome the bottleneck of a conventional parallel technology, and provides a faster data transmission function. The SAS can support and is compatible with serial advanced technology attachment (SATA), and thus has advantages of broad applicability.

In order to make a connector that is portable and occupies little space, the connector is shrunk. In the process of information transmission, a high-frequency transmission technology is applied for rapidly transmitting signals in order to achieve high-speed transmission. However, the shrunk size of the connector dramatically causes distances between plural terminals to be dramatically reduced. Because of the reduced distances, when high-speed signals are transmitted in the terminals, cross talks are likely to occur in adjacent terminals, thus resulting in noises in the originally transmitted high-frequency signals.

Please refer to FIG. 12. Among the conventional art, U.S. Pat. No. 8,808,029 disclosed a high-frequency and high-density connector structure that includes a casing A, a first terminal assembly B, a second terminal assembly C and a shielding plate E. Each of the first terminal assembly B and the second terminal assembly C includes plural conductive terminals D and a base F. The conductive terminals D are inserted into the base F, and the conductive terminals D include plural signal terminals D1 and plural ground terminals D2. Each of the conductive terminals D includes a contact portion D4 and a locating portion D3. The contact portions D4 of the conductive terminals D are exposed from a side surface of the base F, and another surface of the base F has plural openings F1. The ground terminals D2 are exposed through the openings F1. The shielding plate E is formed by punching a metal sheet, and plural contact arms E1 are disposed on a side of the shielding plate E, and the bending directions of the adjacent contact arms E1 are opposite to each other and protrude from a surface of the shielding plate E. The shielding plate E is sandwiched between the first terminal assembly B and the second terminal assembly C. Through the openings F1, the contact arms E1 are in contact with the ground terminals D2, thereby enabling the ground terminals D2 to be electrical contact with the shielding plate E, and grounding capabilities of the ground terminals D2 are enhanced, such that the cross talks and noises occurring in high-frequency signals can be grounded rapidly. Therefore, the mutual interference problems between the conductive terminals can be decreased in high-frequency signal transmission.

The adjacent contact arms E1 on the shielding plate E with different bending directions are alternately disposed, in order to coordinate with the different arrangement sequences of the conductive terminals D of the first terminal assembly B and the second terminal assembly C. The ground terminals D2 of the first terminal assembly B and the second terminal assembly C on a specific projection plane are alternately disposed, such that the ground terminals D2 may coordinate with the contact arms E1 correspondingly. Thus, the contact arms E1 can merely be bent toward one direction on the shielding plate E, such that the contact arms E1 is not suitable for use in an arrangement in which the ground terminals D2 of the first terminal assembly B and second terminal assembly C are simultaneously on the same projecting position. This design of the shielding plate E can merely satisfies a specific arrangement of the conductive terminals D, but is not applicable to all arrangement orders of the conductive terminals D.

Because the design of shielding plate disclosed by the prior art fail to satisfy various arrangements of conductive terminals and fail to meet various requirements of the industry, in order to maintain the better quality of signal transmission of a connector, it is highly desirable to provide an improved design with respect to the connector structure, thereby enabling the design of contact arms on a shielding plate to be applicable to all kinds of arrangements of the conductive terminals.

SUMMARY

An embodiment of the present disclosure provides an electrical connector structure, and specially relate to an electrical connector structure, which is formed from a ground member, a fixing member, plural conductive terminals and plural bases. The present disclosure has a function for effectively suppressing high-frequency noise, and improves interference problems of high-frequency signals.

Another embodiment of the present disclosure provides an electrical connector structure, and specially relate to an electrical connector structure, which is formed from a ground member, a fixing member, plural conductive terminals and plural base. The present disclosure is able to enhance the earthing function of ground member and decrease manufacturing processes, so as to substantially improve productivity.

In order to achieve the forging intention, the present disclosure provides an electrical connector structure, which includes a ground member, a fixing member, plural conductive terminals and two bases. The ground member is formed by bending a metal plate, and the ground member has two opposite ground plates. Plural contact arms protrude from a surface of the ground plates, and two ground plates are connected by a connecting portion. The ground plates of the ground member are installed to the fixing members respectively. The conductive terminals include plural ground terminals and plural signal terminals, and each conductive terminal includes a contact portion, a soldering portion, and a main body connecting the contact and the soldering portion. The main bodies of the conductive terminals are fixed into the bases. The soldering portions extend outside the bases. The bases have plural openings to expose the main bodies of the ground terminals and the signal terminals. The ground member and the fixing member are sandwiched between the two bases. The contact arms of the ground plate are electrically connected the ground terminals through the openings on the bases.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
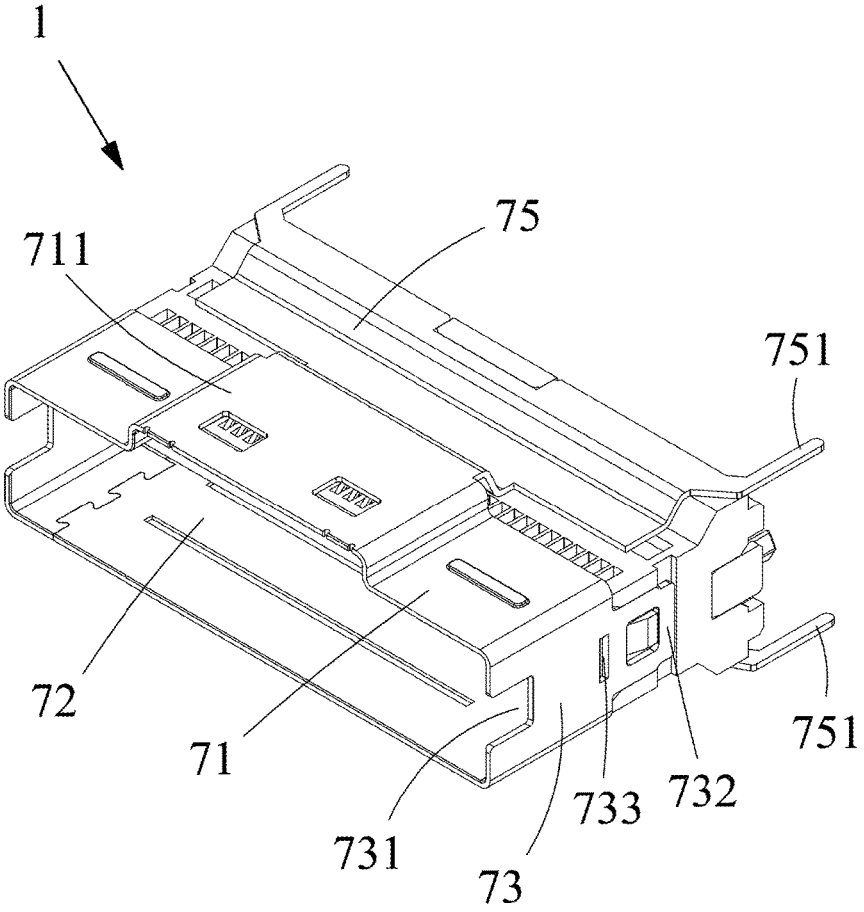
FIG. 1 is an isometric view in accordance with some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
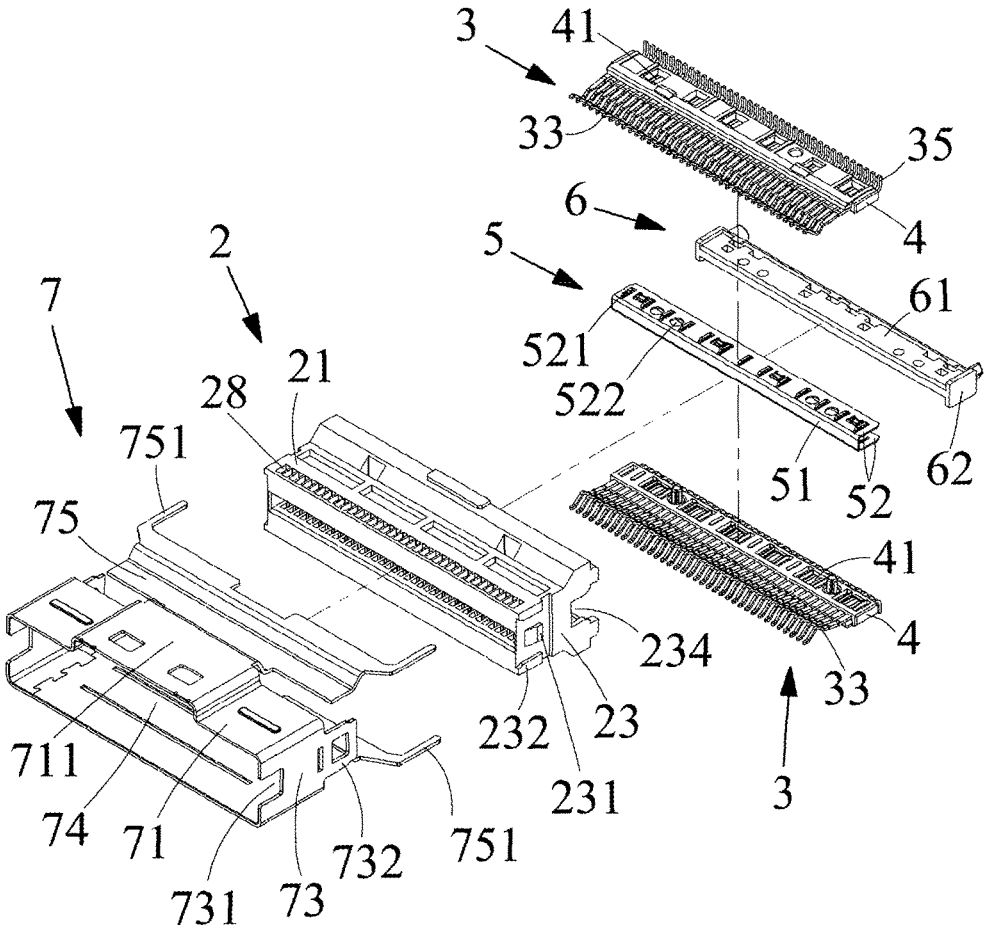
FIG. 2 is an exploded view in accordance with some embodiments of the present disclosure.

Referring to FIG. 1 and FIG. 2, an embodiment of the present disclosure discloses an electrical connector structure 1, which includes an insulating main body 2, plural conductive terminals 3, plural bases 4, a ground member 5, a fixing member 6 and a casing 7, and the electrical connector structure 1 is used to transmit high-frequency signals.

Figure 3:
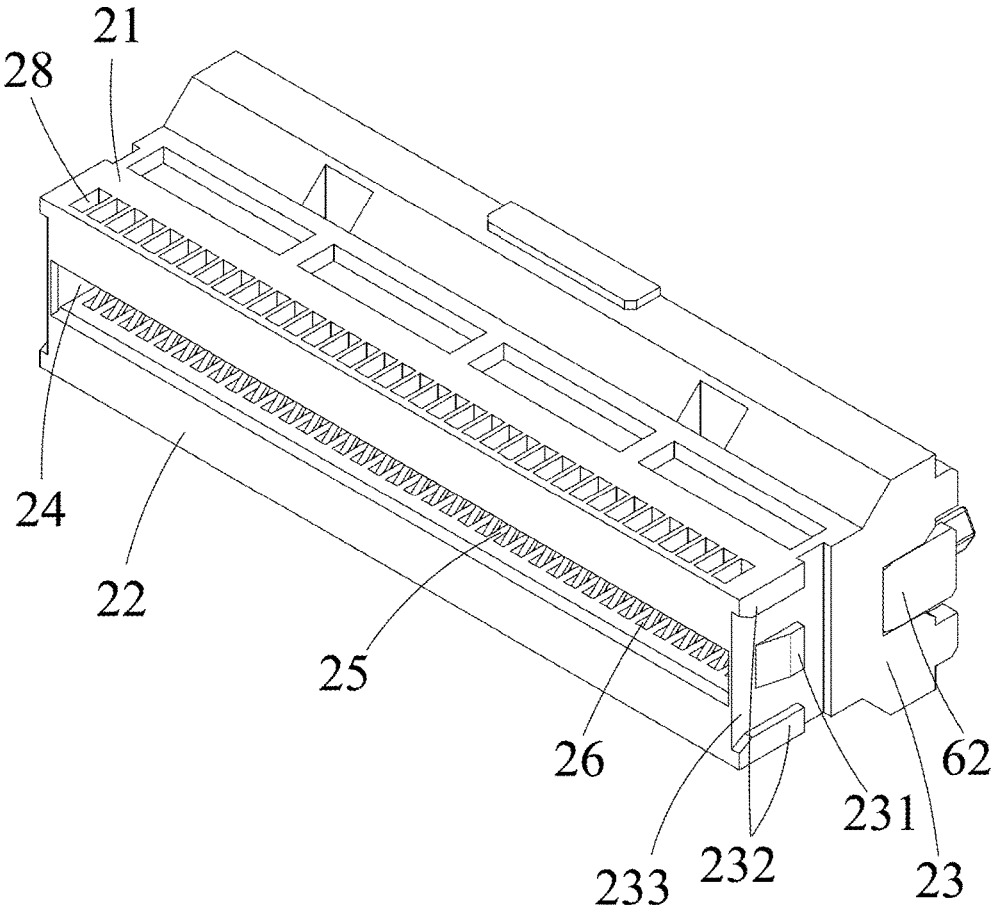
FIG. 3 is an isometric view of some components in accordance with some embodiments of the present disclosure.

In the embodiment of the present disclosure, referring to FIG. 3, the insulating main body 2 is formed from an insulating material, and the insulating main body 2 includes a top plate 21, a bottom plate 22 and two side plates 23. The side plates 23 are connected to the top plate 21 and the bottom plate 22 to form a butt-joint chamber 24. The butt-joint chamber 24 passes through the insulating main body 2. The top plate 21 and the bottom plate 22 have respective surfaces facing to each other, and plural spacer walls 25 are disposed on each of the surfaces. The spacer walls 25 extend along with a direction perpendicular to the top plate 21 or the bottom plate 22. A terminal trench 26 is formed between two adjacent spacer walls 25, such that plural terminal trenches 26 are formed between the plural spacer walls 25. Plural bearing plates 27 are disposed on the spacer walls 25 adjacent to an opening of the butt-joint chamber 24 The bearing plates 27 are connected to the spacer walls 25 respectively, and the bearing plates 27 are parallel to the surfaces of the top plate 21 and bottom plate 22 that face toward each other. The top plate 21 or the bottom plate 22 at each of the terminal trenches 26 has a separate hole 28 adjacent to the opening of the butt-joint chamber 24. A width of the separate hole 28 is about equal to a vertical distance between the facing surfaces of two adjacent spacer walls 25, and the separate hole 28 passes through the top plate 21 or the bottom plate 22, such that the terminal trenches 26 may communicate with a space outside the butt-joint chamber 24 through each corresponding separate hole 28.

An outer surface of the side plates 23 of the insulating main body 2 located far away from the butt-joint chamber 24 has a bulge 231, two bulges 232 and a guide channel 233. The bulges 232 are disposed on the two sides of each side plate 23 connected to the top plate 21 and the bottom plate 22. A recess formed between the bulges 232 is the guide channel 233. A guide direction of the guide channel 233 is consistent with a butt-joint direction of the electrical connector structure, and the bulge 231 is disposed on the guide channel 233. The bulge 231 includes a sloping structure toward the opening direction of the butt-joint chamber 24, such that the bulge 231 facilitates engagements with another structure. Each of the side plates 23 of the insulating main body 2 has a gap 234 on another side opposite to the opening of the butt-joint chamber 24. The gaps 234 can be used to assemble the fixing member 6, such that the fixing member 6 can be assembled into the insulating main body 2.

Figure 4:
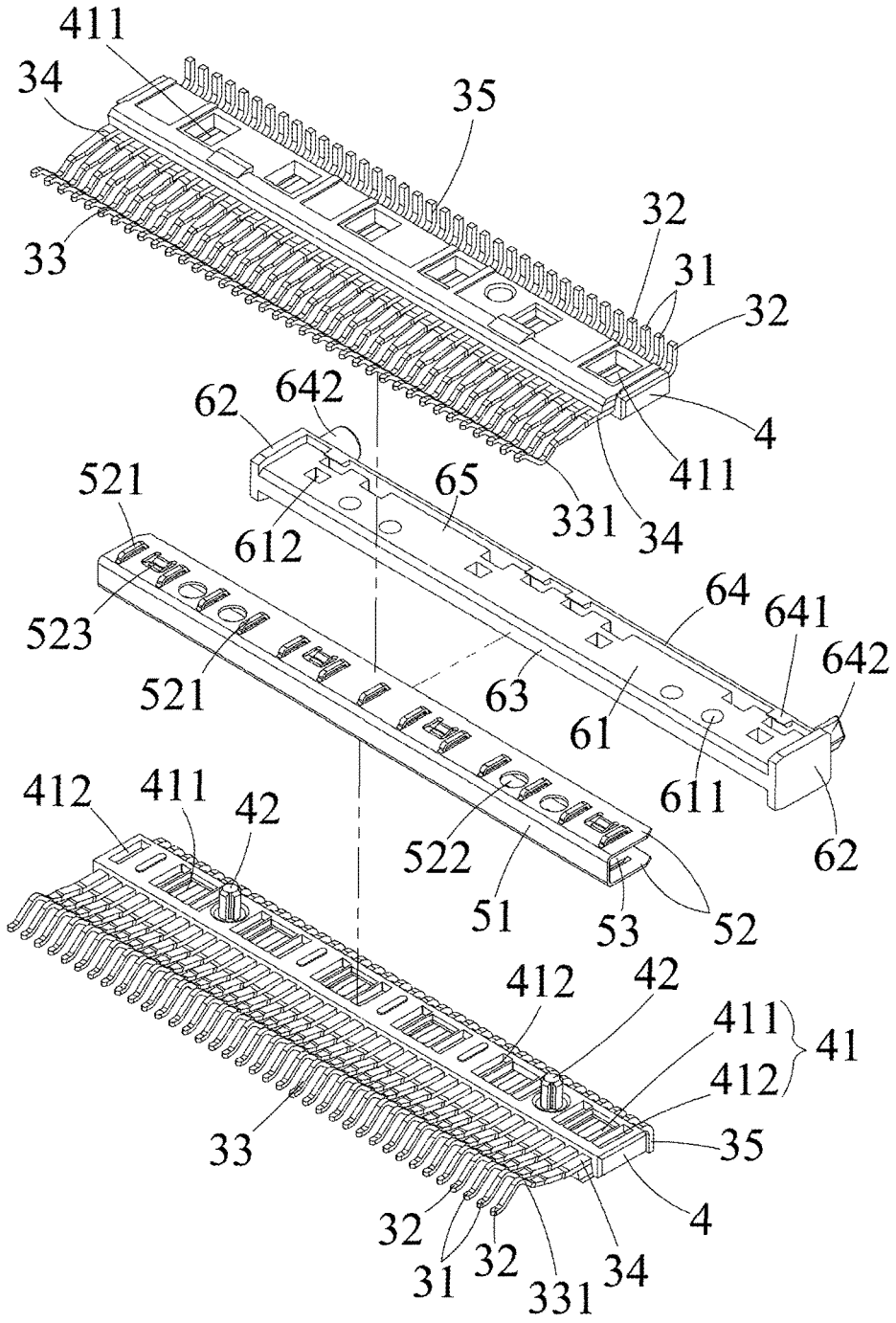
FIG. 4 is an exploded view of some components in accordance with some embodiments of the present disclosure.

In the embodiment of the present disclosure, referring to FIG. 4, the conductive terminals 3 include plural signal terminals 31 and plural ground terminals 32. Each conductive terminal 3 includes a contact portion 33, a main body 34 and a soldering portion 35. The main body 34 is connected to the contact portion 33 and the soldering portion 35. The conductive terminals 3 are disposed in two opposite rows. Each contact portion 33 has a protrusive bending portion 331, and the main bodies 34 of each row of the conductive terminals 3 are fixed into a base 4. The soldering portions 35 and the contact portions 33 protrude from each base 4. The bases 4 have plural openings 41 and plural fixing pillars 42. The fixing pillars 42 are disposed on a side surface of each base 4. The openings 41 include plural first openings 411 exposing signal terminals 31 and plural second openings 412 exposing ground terminals 32. The signal terminals 31 are exposed to the two opposite side surfaces of each base 4 through the first openings 411. The ground terminals 32 are exposed to the same side surface of each base 4 through the second openings 412. The second openings 412 of the two bases 4 face to each other, and a first opening 411 is sandwiched between two second openings 412. The opposite fixing pillars 42 protrude from the bases 4, and the fixing pillars 42 are disposed in a staggered arrangement. The fixing pillars 42 and the second openings 412 are disposed on the same surface. The second openings 412 are not limited to being disposed on the surfaces of the two bases 4 facing towards to each other, and may be disposed on the outer surfaces of the two bases 4 facing outwards. The second openings 412 can be disposed on the exterior opposite surfaces of the two bases 4 (not shown) to expose the ground terminals 32.

The conductive terminals 3 can be fixed into the bases 4 by a manner of inserting or embedding. However, due to the fact that the design of the electrical connector structure 1 is gradually scaled down, the distance between the conductive terminals 3 becomes too small. In order to fix the conductive terminals 3 into each base 4, the present embodiment applies a manner of embedding. The base 4 is formed from plastic material at positions of the main bodies 34 of the conductive terminals 3 by insert molding.

When the conductive terminals 3 are used to transmit high-frequency signals, the interference problems of high-frequency signals are likely to be caused by the signal terminals 31. In order to overcome these problems, the signal terminals 31 transmit high-frequency signals in a manner of differential signal pair. The differential signal pair with two signal terminals can simultaneously transmit differential signals, in which amplitudes of the two differential signals are the same, but phases of the two differential signals are opposite. This manner for transmitting information has a good capability to resist the interference, which can suppress electromagnetic interference (EMI) efficiently, and position the timing accurately, so as to substantially improve the quality and efficiency of transmission. Two sides of the differential signal pairs are adjacent to the ground terminals, and the arrangement sequence is an order of ground terminal-signal terminal-signal terminal-ground terminal (G-S-S-G). The ground terminals can effectively distinguish different differential signal pairs. By shielding and earthing the interference generated from the different differential signals, the mutual interference between the differential signal pairs can be decreased to improve transmission efficiency of high-frequency connectors.

Each first opening 411 of the bases 4 exposes the differential signal pair formed by the signal terminals, and the first openings 411 are in a staggered arrangement. The first openings 411 of the two adjacent differential signal pair of the conductive terminals 3 in the same row are disposed on two opposite surfaces of the base 4 respectively. Due to the staggered arrangement, the first openings 411 are evenly arranged on each base 4 to maintain the structure strength when the bases 4 secure the conductive terminals 3. Moreover, the staggered arrangement of the first openings 411 can achieve longer distances to prevent the exposed differential signal pair in the two adjacent first openings 411 from electromagnetic interference generated by a short distance.

Due to the fact that a dielectric constant of air is small than a dielectric constant of the bases 4, when the bases 4 cover the main bodies 34 of the conductive terminals 3, the bases 4 easily generate different impedances that affecting the signal transmission. In order to resolve this issue, the conductive terminals 3 are partially exposed to air by the first openings 411 and the second openings 412, which can decrease contact areas between the conductive terminals 3 and the bases 4 and increase a contact area between the main body of the conductive terminals 3 and air, so as to change the impedance characteristics of the conductive terminals 3. Therefore, the impedance characteristics of the contact portion 33, the main body 34, and the soldering portion 35 of each of the signal terminals 31 tend to be consistent, so as to adjust the high-frequency transmission characteristics of the electrical connector structure 1.

The ground member 5 is formed by bending a metal plate, and the ground member 5 includes a connecting portion 51 and two ground plates 52 extending from the two opposite sides of the connecting portion 51. The ground plates 52 are parallel to each other, and an accommodating space 53 is formed between the connecting portion 51 and the ground plates 52. The surfaces of the ground plates 52 are provided with plural contact arms 521, plural fixing holes 522 and plural stoppers 523. The contact arms 521 are formed by punching the ground plates 52, and the contact arms 521 extend far away from the accommodate space 53, and protrude from surfaces of the ground plates 52. The adjacent contact arms 521 are parallel to each other, and a shape of the contact arms 521 can be a rib structure or an elastic arm structure. The stoppers 523 are formed by punching the ground plates 52, and the stoppers 523 protrude from surfaces of the ground plates 52, in which the surfaces are adjacent to the accommodate space 53. The fixing holes 522 pass through the ground plates 52, and the stoppers 523 and the fixing holes 522 are adjacent to the contact arms 521. In another embodiment, the connecting portion 51 can be excluded from the ground member 5, but only the two ground plates 52 are retained.

The fixing member 6 is formed from an insulating material, and the fixing member 6 includes two contact surfaces 61, two side walls 62, a front plate 63 and a back wall 64. The contact surfaces 61 are opposite to each other and parallel to each other. The contact surfaces 61 have plural through holes 611 and plural stopper holes 612, and the contact surfaces 61 are slightly lower than the side walls 62 and the back wall 64, which make the side walls 62 and the back wall 64 protrude from the two contact surfaces 61 to form two opposite accommodating recesses 65. The back wall 64 includes plural compressing portions 641 and plural convex pillars 642. The compressing portions 641 are respectively extended toward the contact surfaces 61 from edges of the back wall 64. The compressing portions 641 are perpendicular to the back wall 64, and the compressing portions 641 are disposed parallel to the contact surfaces 61. The compressing portions 641 are spaced apart from the contact surfaces 61 at a distance which is greater than or equal to the thickness of the ground plate 52.

The fixing member 6 is received in the accommodating space 53 of the ground member 5, and the ground member 5 is fixed to the fixing member 6. The ground member 5 includes the ground plates 52 and the connecting portion 51 covering the contact surfaces 61 and the front plate 63 of the fixing member 6, respectively, and the ground plates 52 are limited in the surfaces of the contact surfaces 61 by the compressing portions 641. The fixing holes 522 of the ground plates 52 coincide with centers of the corresponding through holes 611 on the contact surfaces 61 of the fixing member 6. The contact arms 521 of the ground plates 52 extend away from the contact surfaces 61, and protrude from the surfaces of the ground plates 52. The stoppers 523 of the ground plates 52 resist the corresponding stopper holes 612 of the contact surfaces 61. The stoppers 523 and the stopper holes 612 can prevent the ground member 5 from being detached so as to maintain the bonding strength between the fixing member 6 and ground member 5.

After the fixing member 6 and the ground member 5 are assembled, the assembly of the fixing member 6 and the ground member 5 is interposed between the two rows of conductive terminals 3. The fixing pillars 42 of the bases 4 are inserted into the through holes 611 and the fixing holes 522 in which the through holes 611 of the fixing member 6 coincide with the fixing holes 522 of the ground member 5. The fixing pillars 42 are engaged with the through holes 611 after being inserted through the fixing holes 522, and the fixing members 6 and the ground members 5 are fixed by the fixing pillars 42 of the bases 4. The conductive terminals 3 are stably installed on both sides of the fixing member 6 and the ground member 5, and the bases 4 are accommodated in the accommodating recesses 65 of the fixing member 6, respectively. The two opposite sides of the bases 4 are limited by the side walls 62 of the fixing member 6, respectively. The contact arms 521 on the ground plates 52 of the ground member 5 are in contact with the ground terminals 32 exposed by the second openings 412 of the bases 4, and the ground terminals 32 are electrically connected to the ground member 5.

The signal terminal 31 and the ground terminal 32 are exposed by the openings 41 of the base 4, and the conductive terminals 3 are exposed by the openings 41 in order to meet the consistent of the impedance characteristics. However, without the shielding of the base 4, the adjacent signal terminals 31 in the base 4 are susceptible to high-frequency signal interference, so that the ground members 5 and the fixing member 6, which are interposed between the two rows of conductive terminals 3, are made of a metal plate material and an insulating material, respectively. The ground plates 52 of the ground member 5 cover a surface of the base 4 having the first openings 411 and the second openings 412, and the first openings 411 expose the differential signal pairs. The ground plates 52 have a design that absorbs and shields the resulting high-frequency interference of the differential signal pairs, and this design doesn't affect the contact between the differential signal pairs and air. The contact arms 521 of the ground member 5 are electrically connected to the ground terminals 32, and the noise or interference of the adjacent differential signal pairs that is absorbed by the ground terminals 32 is quickly transmitted to the ground member 5 by the contact arms 521 in order to achieve an earthing functionality. Thereby, when transmission of high-frequency signal, the interference between the signal terminals 31 can be reduced to improve the efficiency of the signal transmission.

Figure 5:
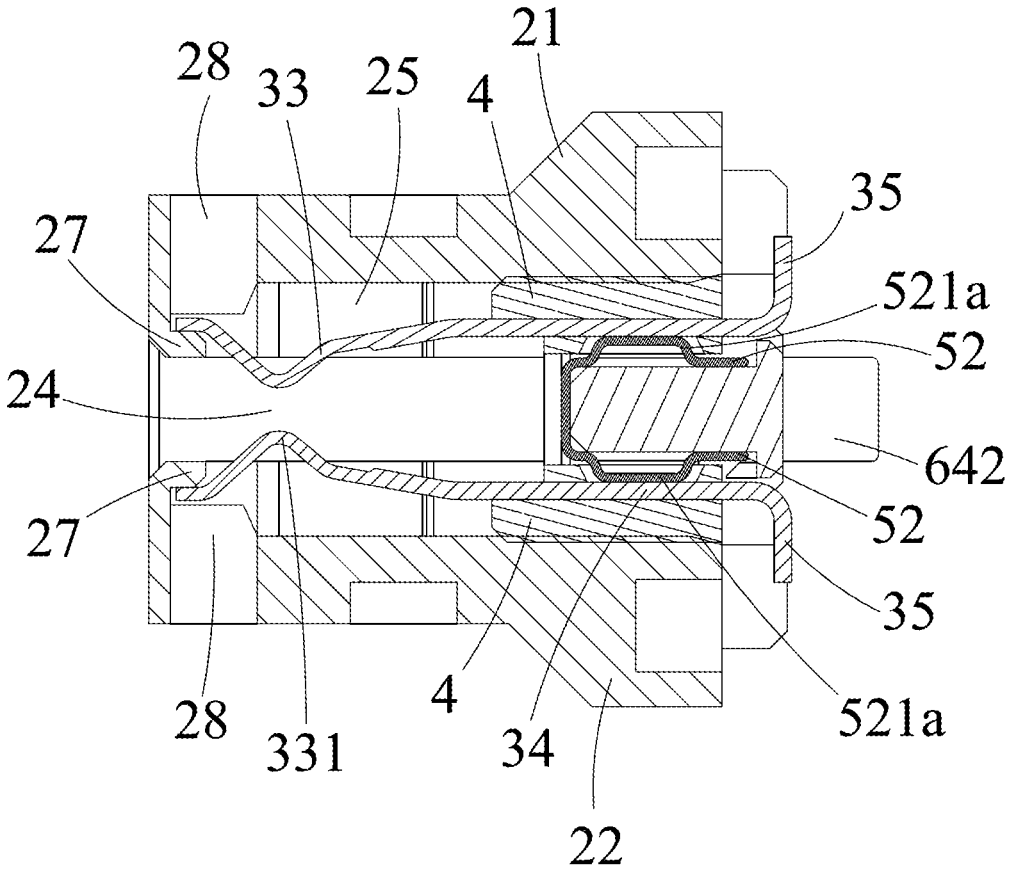
FIG. 5 is a cross-sectional view in accordance with the first embodiment of the present disclosure.
Figure 6:
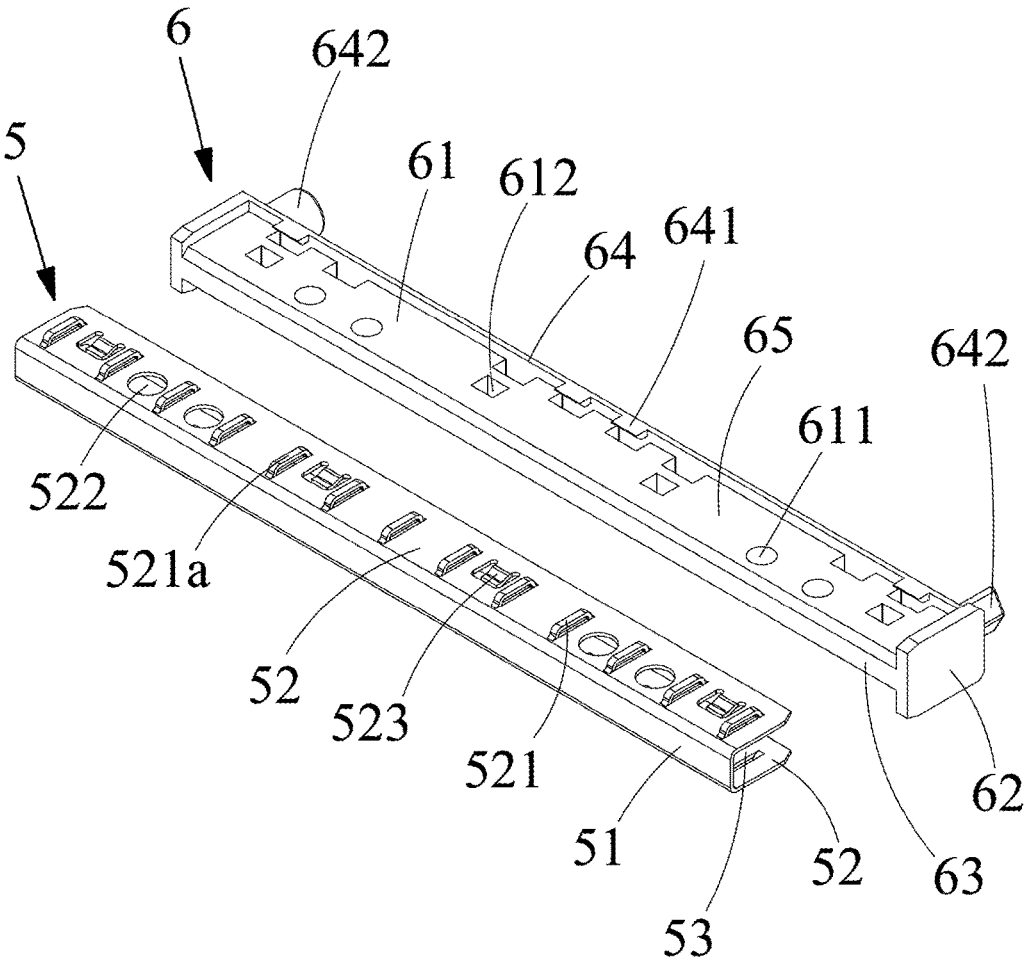
FIG. 6 is an isometric view of some components in accordance with the first embodiment of the present disclosure.

In the first embodiment of the present disclosure, referring to FIG. 5 and FIG. 6, each of the contact arms 521 on the surfaces of the ground plates 52 of the ground member 5 is a rib structure 521*a* which is formed by punching the surface of each ground plate 52. The rib structure 521*a* is a rectangular thin plate protruding from each of the ground plates 52, and each rib structure 521*a* has a contact section (not shown). The contact sections are parallel to the ground plates 52, and the two ends of the each contact section extend to connect the surface of the ground plate 52. The rib structures 521*a* are parallel to each other and have no elasticity, and the rib structures 521*a* are in contact with and electrically connected to the corresponding ground terminals 32 through the second openings 412 of the bases 4. The contact section of the rib structures 521*a* has a flat contact surface which is in contact with the ground terminals 32, and the contact surface is larger than the contact surface of the conventional generally elastic arms structure connected to the ground terminals 32. The noise or high-frequency interference which is generated by the differential terminal pairs and received by the ground terminals 32 can be transmitted by the larger area of the rib structures 521*a*, and the noise or interference is transmitted to the ground plates 52 through the rib structures 521*a*. Since the rib structures 521*a* are in contact with the ground terminals 32 in a large area, and both ends of the rib structure 521*a* are connected to the ground plates 52, so that the electron transmission functionality of the earthing can be greater and faster, and the anti-high-frequency-interference capability of adjacent differential signal pair shielded by the ground terminals 32 can be increased. Thereby, the overall high-frequency signal transmission quality can be improved. Due to the different processing conditions, the flatness of contact surfaces between the rib structures 521*a* and the ground terminals 32 may be uneven and then affects the conductive quality. A further design is proposed for this problem, in which the contact section of each rib structure 521*a* includes two end portions connected to corresponding the ground plates 52 and a middle portion connected between the end portions, heights the two end portions of each rib structure 521*a* are greater than a height of the middle portion of each rib structure 521*a*, and the definitions of the heights are vertical distances between surfaces of the ground plates 52 and the rib structures 521*a* on the ground plates 52. This design can decrease the unevenness problem of the contact surfaces between the rib structures 521*a* and the ground terminals 32. Due to the fact that the middle portion of the contact sections of the rib structure 521*a* is designed to be lower than the end portions of that, the condition in which the middle portion height of the rib structure 521*a* is too high so that the other positions can't be in contact with the ground terminals 32 can be eliminated. As a result, the end portions of the rib structure 521*a* can be stably connected to each of the ground terminals 32 to achieve a better earthing effect.

Figure 7:
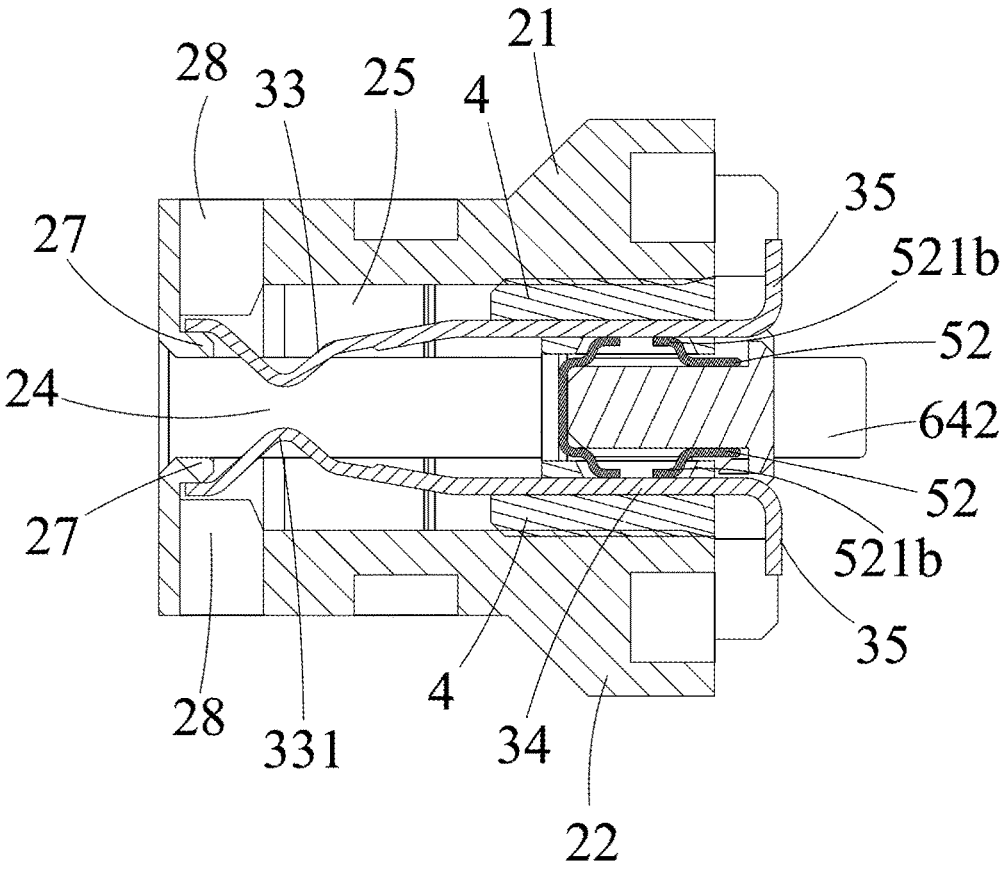
FIG. 7 is a cross-sectional view in accordance with the second embodiment of the present disclosure.
Figure 8:
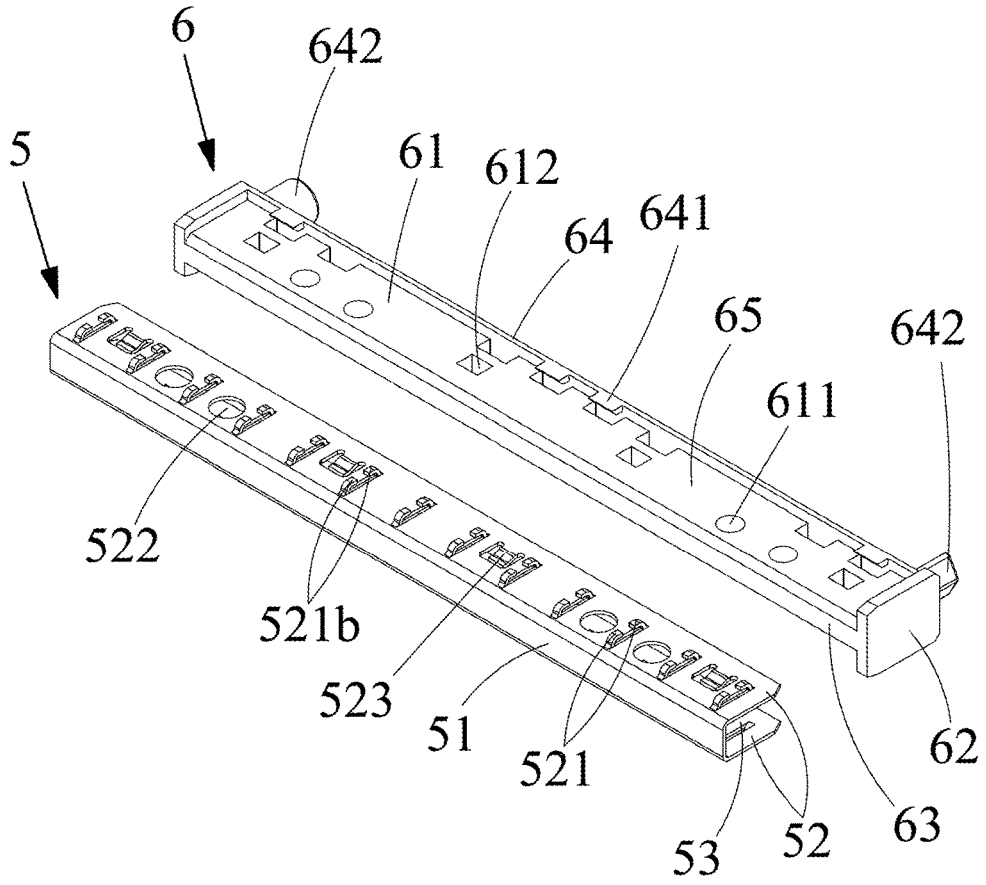
FIG. 8 is an isometric view of some components in accordance with the second embodiment of the present disclosure.

In the second embodiment of the present disclosure, referring to FIG. 7 and FIG. 8, each contact arm 521 of the ground plates 52 surfaces of the ground member 5 is formed from a pair of first elastic arms 521*b*. The first elastic arms 521*b* are modified from the rib structures 521*a* of the first embodiment, in which the middle portion of the contact sections of the each rib structure 521*a* is cut away, and two end portions of the contact sections of the rib structures 521*a* connected to the ground plate 52 are remained, thereby forming a pair of the first elastic arms 521*b* extending oppositely. The two first elastic arms 521*b* extending oppositely have a distance therebetween. The first elastic arms 521*b* are formed by punching the surfaces of the ground plates 52. Each pair of the first elastic arms 521*b* protrudes and is connected to the surface of the ground plate 52. Each pair of first elastic arm 521*b* has elasticity, and two first elastic arms 521*b* of a first elastic arm 521*b* pair extend oppositely. The two first elastic arms 521*b* are spaced with a distance, and the two first elastic arms 521*b* of each pair are in contact with and electrically connected to the same ground terminal 32 exposed by the corresponding second opening 412 of the base 4. In a comparison of the first elastic arms 521*b* with the rib structures 521*a* of the first embodiment, when the contact surfaces of the rib structures 521*a* connected with the ground terminals have an uneven bulge, contact points between the rib structures 521*a* and the ground terminals 32 are decreased substantially, so that the earthing effect is substantially reduced. However, each pair of the first elastic arms 521*b* has two contact surfaces in contact with the same ground terminal 32, and the two contact surfaces are spaced with a consistent distance. Therefore, the influence of the height of contact surfaces and the surface flatness of each pair of the first elastic arms 521*b* in contact with ground terminals 32 can be reduced, such that, the first elastic arms 521*b* can be stably contact the ground terminals 32, and then the risk of poor contact can be reduced. This design provides each ground terminal 32 with two first elastic arms 521*b* to achieve the earthing functionality. The conductive paths of the first elastic arms 521*b* contacting the ground terminals 32 and connected to the ground plate 52 are shorter than that of the rib structures 521*a*. Due to the reduced length of the conductive paths, the noise or high-frequency interference received by the ground terminals 32 can be quickly grounded by the two different first elastic arms 521*b*. Due to the improved earthing efficiency of the ground terminals 32, the anti-high-frequency-interference ability of the adjacent differential signal pair shielded by the ground terminals 32 can be improved. Therefore, the quality of the overall high-frequency transmission can be improved.

Figure 9:
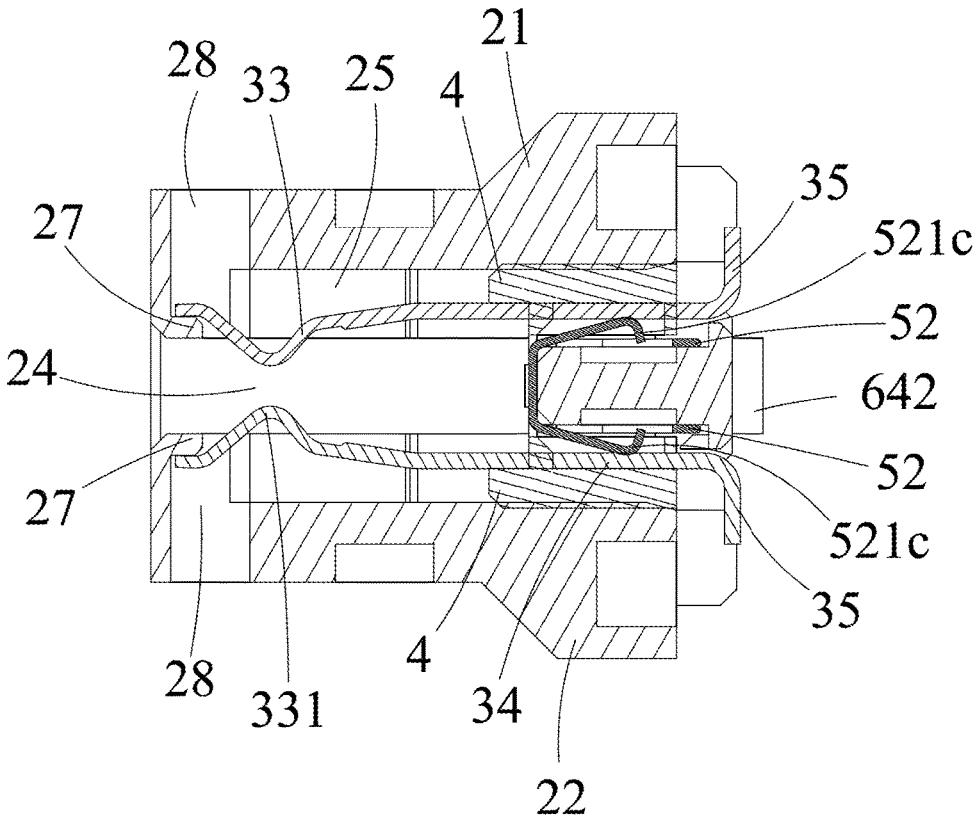
FIG. 9 is a cross-sectional view in accordance with the third embodiment of the present disclosure.
Figure 10:
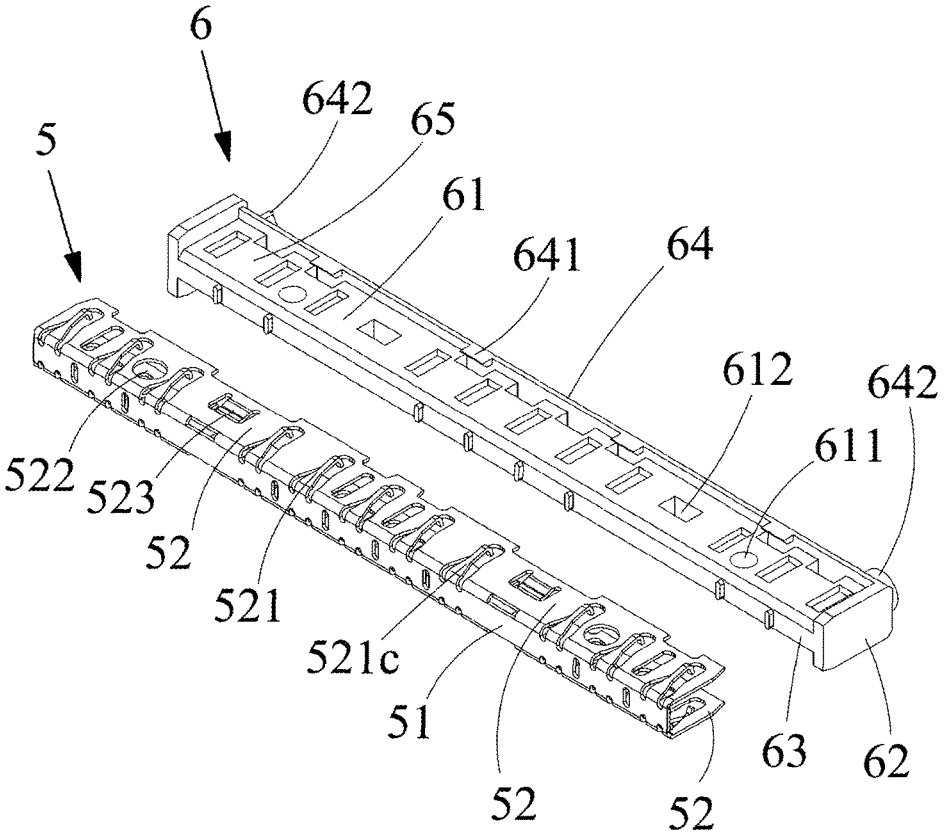
FIG. 10 is an isometric view of some components in accordance with the third embodiment of the present disclosure.

In the third embodiment of the present disclosure, referring to FIG. 9 and FIG. 10, each contact arm 521 of the ground plates 52 surfaces of the ground member 5 is formed from a second elastic arm 521*c*. The second elastic arms 521*c* are formed by punching the ground member 5. Each second elastic arm 521*c* extends from the connecting portion 51 of ground member 5 to ground plate 52 of ground member 5, and the second elastic arms 521*c* protrude from the surface of the ground plate 52. The ends of second elastic arm 521*c* extend along a direction toward to the surfaces of ground plates 52, and the second elastic arms 521*c* are in contact with and electrically connected to the connecting portion 51. A width of portions of the second elastic arms 521*c* adjacent to the connecting portion 51 is wider than the end width of the second elastic arms 521*c*. The width of each second elastic arm 521*c* from the connecting portion 51 to the end of ground terminal 32 is gradually decreased, and the end of each second elastic arm 521*c* remains a consistent width to be connected to each ground terminal 32. All second elastic arms 521*c* have elasticity, and the ends of the second elastic arms 521*c* are in contact with and electrically connected to the ground terminals 32 exposed by the second opening 412 of the bases 4. The second elastic arms 521*c* have a forward force resisting the corresponding ground terminal 32, such that, the second elastic arms 521*c* can be stably in contact with the ground terminals 32, and then the risk of poor contact can be reduced. The designed widths of the second elastic arms 521*c* are getting wider and wider as approaching the connecting portion 51. In this design, the volume of the second elastic arms 521*c* can be enhanced, and the enhanced volume can enhance the conductive volume. Therefore, the noise or high-frequency interference received by the ground terminals 32 can be quickly grounded by the second elastic arms 521*c*, and then the earthing efficiency can be improved. Therefore, the quality of the high-frequency transmission can be improved.

Figure 11:
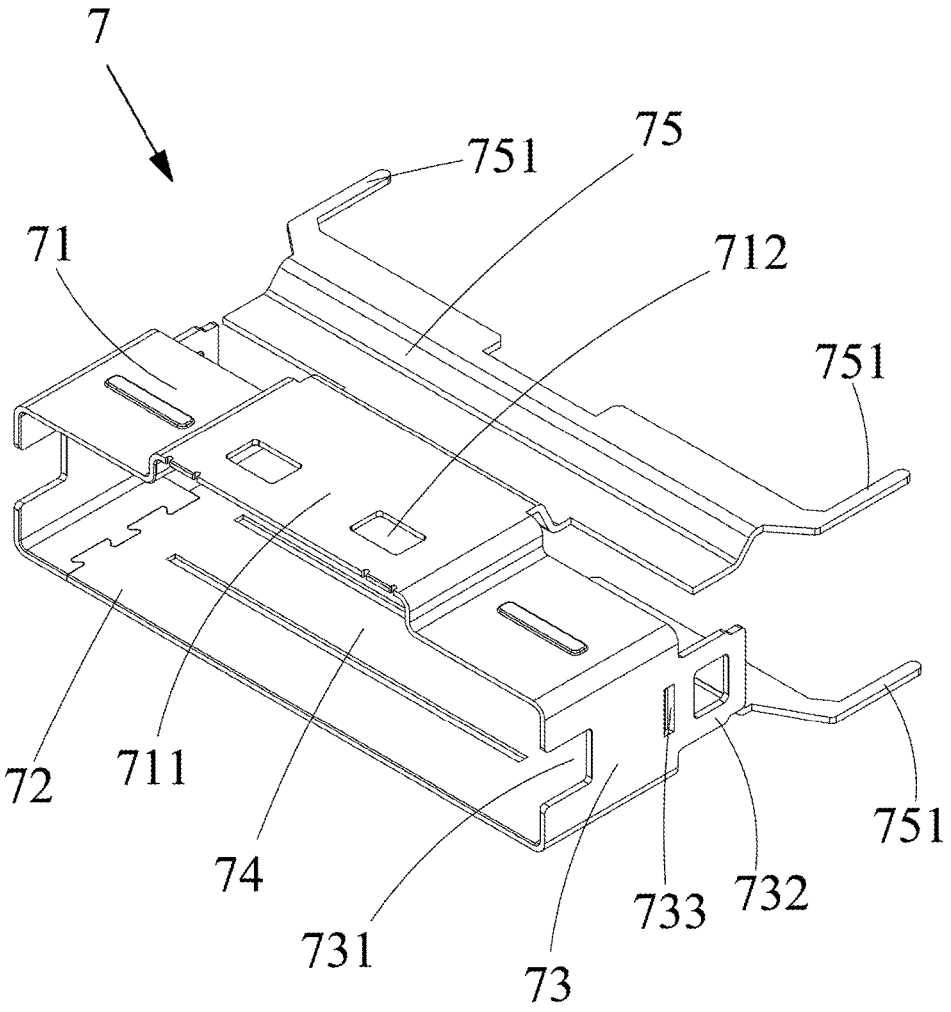
FIG. 11 is an isometric view of some components in accordance with some embodiments of the present disclosure.
Figure 12:
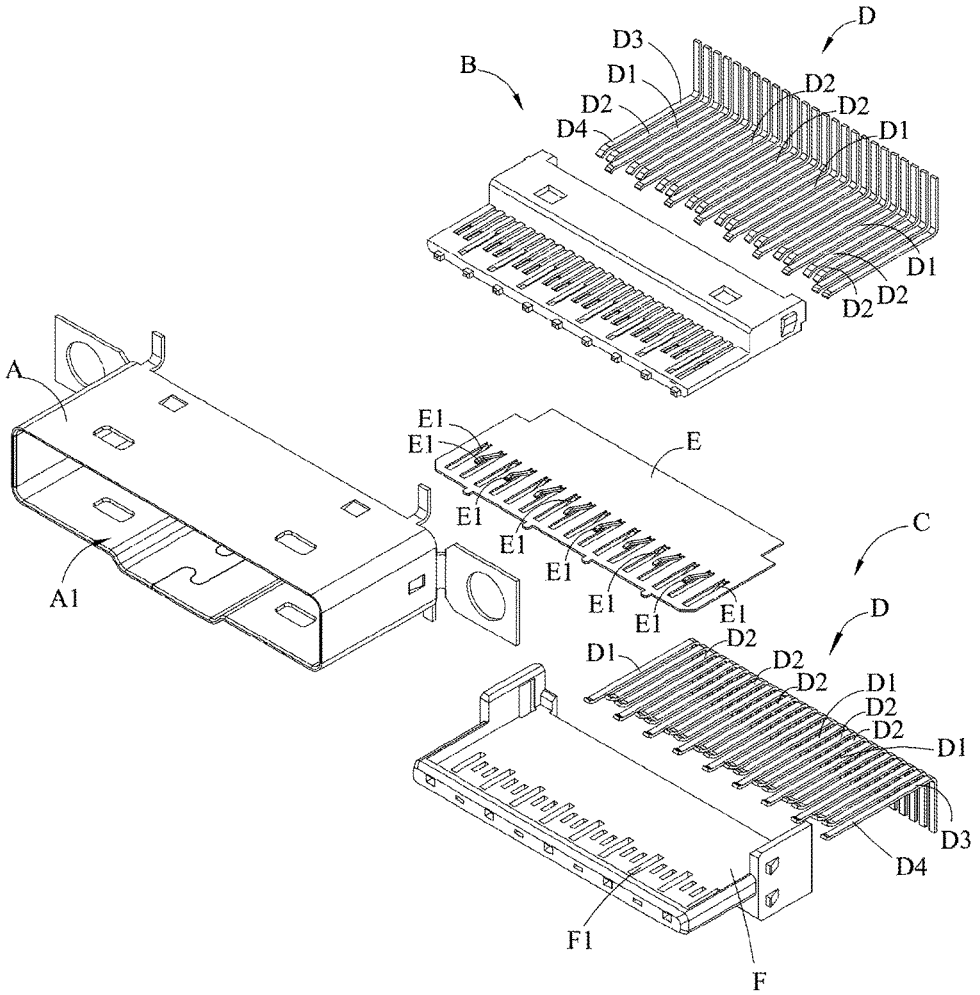
Fig. 12 ( PRIOR ART )
FIG. 12 is a diagram of the U.S. Pat. No. 8,808,029.

In the fourth embodiment of the present disclosure, the second openings 412 of the bases 4 respectively expose the ground terminals 32, and the second openings 412 are not limited to be designed on the facing surfaces of the bases 4, and the second openings 412 can be designed on the opposite and exterior surfaces of the bases 4. The ground plates 52 of the ground members 5 are disposed independently, and aren't connected to each other. The surfaces of the ground plate 52 have the protruding elastic arms or the ribs, and the ground plates 52 are fixed in the exterior surfaces of the bases 4, the facing interior surfaces, or both the exterior surfaces and interior surfaces of the bases 4. The elastic arms or the ribs are connected to the ground terminals 32 of the bases 4 by the second openings 412. In order to achieve a better earthing effect, the ground plates 52 can be fixed into the surfaces of the bases 4 by any one of hot pressing, engaging, clamping and embedding In some embodiments of the present disclosure, referring to the FIG. 11, the casing 7 is made of metal material. The casing 7 includes a top wall 71, a bottom wall 72 and two connecting wall 73, in which an accommodating space 74 is formed by connecting the top wall 71 and bottom wall 72 with the two connecting walls 73. The top wall 71 has a connection 711, which is a protruding structure extending away from the accommodating space 74 along a direction perpendicular to a surface of the top wall 71. The surface of the connection 711 has plural butt-joint holes 712 to fix a butt-joint device (not shown), and covering portions 75 extend from the connection 711 and the bottom wall 72, respectively. The connecting walls 73 are parallel to each other, and an edge of opening of the accommodating space 74 adjacent to each connecting wall 73 has a notch 731. A buckle 732 extends from an edge of the other side opposite to each notch 731. Protecting structures 733 are respectively disposed between the connecting walls 73 and the corresponding buckles 732. The protecting structures 733 are a protruding structure, which are perpendicular to each connecting wall 73 and extend in a direction toward the accommodating space 74. The protecting structures 733 can efficiently protect and prevent the insulating main body 2 from being damaged. Plural pins 751 extend form each covering portion 75 of the top wall 71 and the bottom wall 72.

In some embodiments in the present disclosure, referring to FIG. 5, the assembly of the ground member 5 and the fixing member 6 which are clamped by the two rows of the conductive terminals 3 is installed into the butt-joint chamber 24. The conductive terminals 3 are disposed in the terminal trenches 26 on the top plate 21 and the bottom plate 22 of the insulating main body 2, respectively. The front ends of the contact portions 33 of the conductive terminals 3 resist the corresponding bearing plates 27. The bending portions 331 extend oppositely from the contact portions 33 of the two rows of the conductive terminals 3 in a direction toward to the butt-joint chamber 24. Therefore, the bending portion 331 is higher than the spacer walls 25 of the two sides of each terminal trench 26. The conductive terminals 3 are easy to be electrically connected to the butt-joint device through the design of the bending portion 331 which is higher than the spacer walls 25. The assembly of the ground member 5 and the fixing member 6 which are clamped by the two bases 4 is fixed into the gap 234 of the side plates 23 of the insulating main body 2, and is interposed between the top plate 21 and the bottom plate 22, in which the soldering portion 35 of the conductive terminals 3 extends out of the insulating main body 2.

The front end of the contact portion 33 of each conductive terminal 3 exerts a force to the corresponding bearing plate 27. The front end of each contact portion 33 is constrained by the bearing plates 27, so that the contact portions 33 can only reversely elastically deform toward the bearing plate 27. Therefore, when the contact portions 33 are not in contact with the butt-joint device yet, the contact portions 33 are subject to a pre-load provided by the bearing plates 27. When the electrical connector structure 1 is inserted into the butt-joint device, the contact portions 33 of each conductive terminal 3 are able to output a larger normal force so that the signal transmission is more stable. The separate holes 28 of the top plate 21 and the bottom plate 22 of the insulating main body 2 are able to increase the space of the terminal trenches 26. When the butt-joint device joints the contact portions 33, the contact portions 33 of the conductive terminals 3 are deformed by force, and are moved in a direction toward the top plate 21 or the bottom plate 22. And then the separate holes 28 of the top plate 21 and the bottom plate 22 are able to provide a larger space for accommodating the each contact portion 33 of the conductive terminals 3 so as to prevent the conductive terminals 3 from breakage or irreversible deformation caused by pressing the top plate 21 or the bottom plate 22. Thus, the integrity of the shape of the conductive terminals 3 can be maintained.

In some embodiments in the present disclosure, referring to FIG. 1, the casing 7 is provided on an opening side of the butt-joint chamber 24 of the insulating main body 2. Each buckle 732 of the connecting walls 73 of the casing 7 is installed along the guide channel 233 on each side plate 23 of the insulating main body 2. The buckles 732 are engaged with the corresponding bulges 231, respectively. The protecting structures 733 of the casing 7 are respectively adjacent to the surfaces of the side plates 23 at the opening of the butt-joint chamber 24 of the insulating main body 2. The functionality of the protecting structure 733 is used to guide a inserting direction of a tongue plate (not shown) to make the tongue plate be successfully inserted into the butt-joint chamber 24 of the insulating main body 2, and the protecting structures 733 are able to effectively prevent the insulating main body 2 from being scratched by the tongue plate, so that the life time of the electrical connector structure 1 can be increased. The covering portions 75 of the casing 7 extend from the connection 711 of the top wall 71 to the surface of the top plate 21 of the insulating main body 2, and extend from the bottom wall 72 to the surface of the bottom plate 22 of the insulating main body 2, respectively. Each pin 751 of the covering portions 75 extends far away from the insulating main body 2. The accommodating space 74 which are formed by the casing 7 and the butt-joint chamber 24 of the insulating main body 2 is interconnected with each other. Moreover, the electrical connector structure 1 of the present disclosure is not limited to the casing 7, and for another embodiment, the casing 7 can be excluded.

Compared with the prior art, the conventional ground member is formed by punching a metal plate, the contact arms cannot provide bending of two-opposite-sides at the same position, and the contact areas between the contact arms and the ground terminals and the stability of conductivity still need improvements. In the present disclosure, the ground member is improved. A metal thin plate is bended to form a U-shaped structure constituted by a connecting plate connecting the two parallel ground plates 52, in which the contact arms 521 are formed by punching the surface of the two opposite ground plates 52. In the specific projection, the contact arms 521 on the two opposite ground plate can overlap with each other or don't overlap with each other, so the position design of the contact arms 521 on the ground plates 52 is more flexible. Each ground plate 52 is corresponding to a row of the conductive terminals 3, and the positions of the contact arms 521 on the ground plates 52 are designed by the positions of the corresponding ground terminals 32, in which the contact arms 521 can be elastic arms or rib structures. The design of the ground member 5 in which the two ground plates 52 are both connected to the connecting portion 51 is designed for being assembled easily. Due to the fact that the relative position of the contact arms 521 on the two ground plate 52 are not easily varied and can be easily provided to the fixing member 6, the contact arms 521 can be easily aligned and assembled with each ground terminal 32 of the conductive terminals 3. Therefore, the assembly process and the design cost can be efficiently decreased, and yield of production can be enhanced.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An electrical connector structure, comprising;

a plurality of ground terminals arranged in two rows fixed into two bases respectively, wherein each of the ground terminals comprises a contact portion, a soldering portion, and a main body connecting the contact portion and the soldering portion, the main body is fixed into a corresponding one of the bases, and the soldering portion extends outside a corresponding one of the bases; and a ground member comprising two ground plates respectively covering surfaces of the bases, wherein each of the ground plates has a surface and a plurality of contact arms protruding from the surface, the contact arms are electrically connected to the ground terminals respectively, and two ends of each of the contact arms are respectively connected to the ground plates, wherein the ground member is formed by two opposite sides of a connecting portion respectively connected to the ground plates, and the ground plates and the connecting portion forms an accommodating space.

2. The electrical connector structure of claim 1, wherein each of the contact arms comprises at least one contact surface electrically connected to the ground terminals.

3. The electrical connector structure of claim 1, wherein the ground member is a monolithically formed structure.

4. The electrical connector structure of claim 1, wherein a fixing member is sandwiched between the ground plates, and the ground plates are respectively fixed on two contact surfaces of the fixing member.

5. The electrical connector structure of claim 1, wherein the bases have a plurality of openings to respectively expose the ground terminals, and the contact arms are respectively connected to the ground terminals through the openings.

6. The electrical connector structure of claim 1, wherein the ground plates are formed from a metal sheet, and the ground plates are parallel to each other.

7. The electrical connector structure of claim 1, wherein the contact arms are structures with elastic recovery or without elastic recovery.

8. The electrical connector structure of claim 1, wherein each of the contact arms is formed from a rib structure or two elastic arm structures.

9. The electrical connector structure of claim 8, wherein the two elastic arm structures of one of the contact arms extend toward each other, and spaced from each other at a constant distance.

* * * * *